US005991560A

United States Patent [19]

Jenkins

[11] Patent Number: 5,991,560

[45] Date of Patent: Nov. 23, 1999

[54] DETERMINING AN AMOUNT OF TONER IN A RESERVOIR BY DETERMINING A TIME INTERVAL FOR THE TRANSMISSION OF LIGHT BETWEEN A FIRST LIGHT GUIDE AND A SECOND LIGHT GUIDE

[75] Inventor: Rowland L. Jenkins, Boise, Id.

[73] Assignee: Hewlett-Packard Company, Palo Alto, Calif.

[21] Appl. No.: 09/119,169

[22] Filed: Jul. 20, 1998

[51] Int. Cl.[6] ..... G03G 15/08

[52] U.S. Cl. ..... 399/61; 399/27; 399/256

[58] Field of Search ..... 399/61, 119, 27, 399/262, 256

[56] References Cited

U.S. PATENT DOCUMENTS

| | | | |
|---|---|---|---|
| 4,155,638 | 5/1979 | Blitzer | 399/59 |
| 4,392,142 | 7/1983 | Searchman et al. | 347/81 |
| 4,767,172 | 8/1988 | Nichols et al. | 355/1 |
| 5,499,077 | 3/1996 | Endo et al. | 399/27 |
| 5,649,264 | 7/1997 | Domon et al. | 399/30 |

FOREIGN PATENT DOCUMENTS

| | | |
|---|---|---|
| 1-145676 | 6/1989 | Japan . |
| 9-288418 | 11/1997 | Japan . |

*Primary Examiner*—Arthur T. Grimley
*Assistant Examiner*—Quana Grainger
*Attorney, Agent, or Firm*—Gregg W. Wisdom

[57] ABSTRACT

A first embodiment of the system to detect the amount of toner includes a first and a second light pipe attached in a substantially parallel orientation from the top to the bottom of a sidewall in the toner reservoir. An infra-red light emitting diode illuminates the first light pipe. A rotatable auger has an attached first arm. A light bridge attached to the first arm is positioned so that during rotation of the auger, the light bridge moves adjacent to the first and the second light pipe as the light bridge moves from the top to the bottom of the toner reservoir. When the light bridge is outside of the toner and adjacent to the first and the second light pipe, light is transmitted between the first and the second light pipe. When the light bridge is inside of the toner, light transmission between the first and the second light pipe is interrupted. A circuit detects light transmitted from the second light pipe using a photodiode. The circuit determines the amount of toner remaining in the toner reservoir by measuring the time interval during which light is detected and using this measurement to perform an interpolation that determines the amount of toner remaining. Other embodiments of the system to detect the amount of toner include the use of an auger that transmits light between a single light pipe and the circuit, rotating belts for moving the light bridge, light polarizers to selectively prevent light transmission, and additional light pipes.

20 Claims, 12 Drawing Sheets

DETERMINING AN AMOUNT OF TONER IN A RESERVOIR BY DETERMINING A TIME INTERVAL FOR THE TRANSMISSION OF LIGHT BETWEEN A FIRST LIGHT GUIDE AND A SECOND LIGHT GUIDE

FIELD OF THE INVENTION

This invention relates to the field of electrophotographic imaging. More particularly, this invention relates to the detection of an amount of toner in a reservoir in an electrophotographic imaging device such as an electrophotographic printer or electrophotographic copier.

BACKGROUND OF THE INVENTION

Electrophotographic imaging involves the development of toner onto a latent electrostatic image formed on the surface of a photoconductor. In electrophotographic printing, the latent electrostatic image is developed by selectively discharging the surface of the photoconductor using a laser. In both electrostatic copying and electrostatic printing, toner stored in a reservoir is supplied to a developer used for developing the electrostatic image.

Near the time useable amounts of toner from the reservoir have been consumed, the print quality can be degraded. Without a device for determining the amount of toner remaining in the toner reservoir, the electrophotographic imaging system can generate output that will be discarded because of unacceptable print quality. Furthermore, if the electrophotographic printer uses a cartridge containing the toner, the inability to determine the level of toner remaining in the cartridge can result in prematurely discarding the cartridge. Therefore, a need exists for a device that will allow accurate detection of the amount of toner in the reservoir of an electrophotographic imaging device.

SUMMARY OF THE INVENTION

Accordingly, an apparatus using a light source to determine an amount of toner in a reservoir includes a first light guide configured to receive light from the light source. The first light guide is positioned in the reservoir so that depletion of the toner exposes part of the first light guide. The apparatus further includes a light coupling member configured to move between a first position outside the toner and a second position inside the toner so that with the light coupling member located in the first position, the light coupling member receives substantially unattenuated light from the first light guide and so that with the light coupling member located in the second position, the toner attenuates the transmission of light from the first light guide to the light coupling member. The apparatus further includes a circuit coupled to the light coupling member. The circuit is used for determining a time interval based upon measurement of the time during which the light coupling member receives substantially unattenuated light from the first light guide. The circuit is used to determine the amount of toner using the time interval.

In an electrophotographic printing system, an apparatus to determine an amount of toner in a reservoir includes a light source to generate light. The apparatus further includes a first light guide configured to receive light from the light source. The first light guide is positioned in the reservoir so that depletion of the toner exposes part of the first light guide. The apparatus further includes a light coupling member configured to move between a first position outside the toner and a second position inside the toner so that with the light coupling member located in the first position, the light coupling member receives substantially unattenuated light from the first light guide and so that with the light coupling member located in the second position, the toner attenuates the transmission of light from the first light guide to the light coupling member. The apparatus further includes a circuit optically coupled to the light coupling member. The circuit is used for determining a time interval based upon measurement of the time during which the light coupling member receives substantially unattenuated light from the first light guide. The circuit is used to determine the amount of toner using the time interval.

An electrophotographic printing system includes a reservoir to contain toner, a light source to generate light, and an apparatus to determine an amount of the toner using the light source. The apparatus includes a first light guide configured to receive light from the light source and with the first light guide positioned in the reservoir so that depletion of the toner exposes part of the first light guide. The apparatus further includes a light coupling member configured to move between a first position outside of the toner and a second position inside of the toner. The light coupling member receives substantially unattenuated light from the first light guide in the first position and the transmission of the light from the first light guide to the light coupling member is attenuated in the second position. The apparatus further includes a circuit optically coupled to the light coupling member. A method for determining the amount of toner using the apparatus includes the step of determining a time interval based upon measurement of the time during which the light coupling member receives substantially unattenuated light from the first light guide. The method further includes the step of computing the amount of toner using the time interval.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The present invention is not limited to the specific exemplary embodiments illustrated herein. Although the embodiments of the system to detect the amount of toner will be discussed in the context of a monochrome electrophotographic printer using an electrophotographic print cartridge, it should be recognized that the system to detect the amount of toner is applicable in other electrophotographic imaging systems such as color electrophotographic printers or electrophotographic copiers. An important requirement for implementing the system to detect the amount of toner in an electrophotographic print cartridge is that it has the mechanical robustness necessary to endure the level of mechanical shock which an electrophotographic print cartridge will experience during handling and installation. The disclosed embodiments of the system to detect the amount of toner can be constructed to possess this characteristic.

Figure 1:
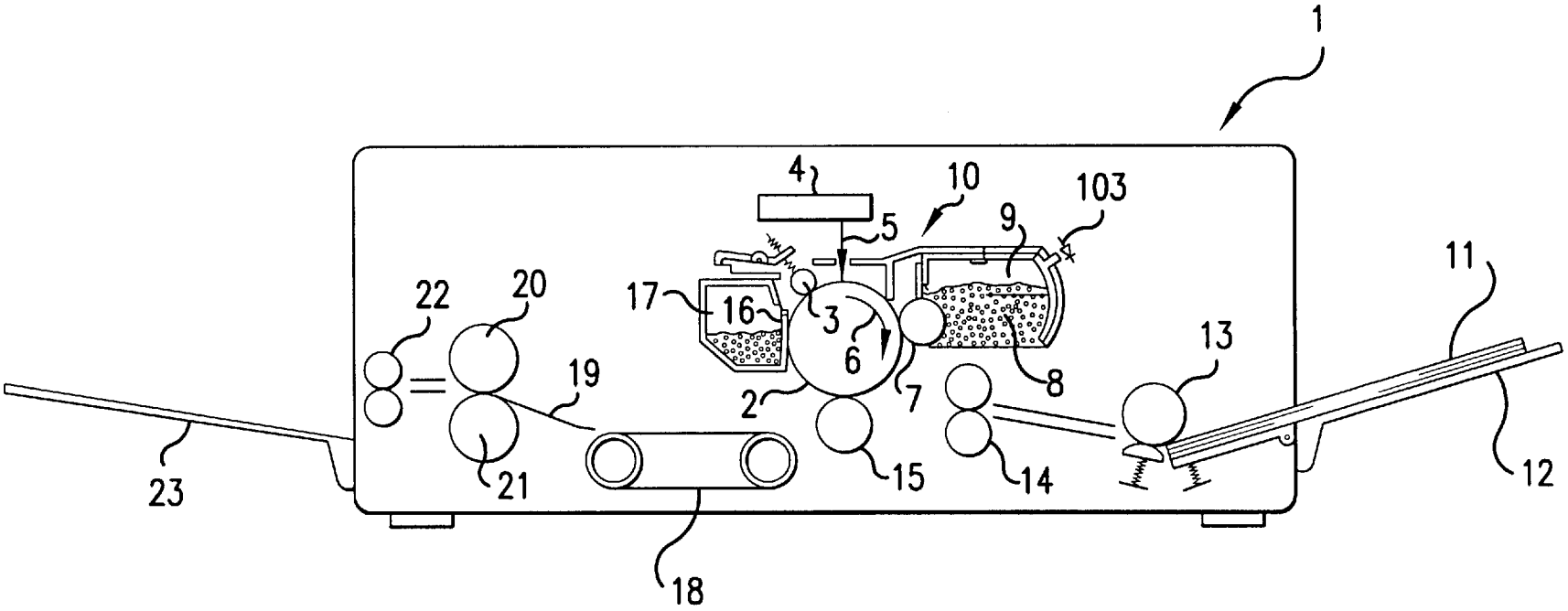
FIG. 1 shows a simplified cross section of an electrophotographic printer including part of a first embodiment of the system to detect the amount of toner.

Shown in FIG. 1 is a simplified cross sectional view of an electrophotographic printer 1 including an embodiment of the system to detect the amount of toner. The surface of photoconductor drum 2 is charged by charge roller 3 to a pre-determined voltage. A laser diode (not shown in FIG. 1) inside laser scanner 4 emits a laser beam 5 which is pulsed on and off as it is swept across the surface of photoconductor drum 2 to selectively discharge the surface of the photoconductor drum 2. Photoconductor drum 2 rotates in the clockwise direction as shown by the arrow 6. Developer roller 7 is used to develop the latent electrostatic image residing on the surface of photoconductor drum 2 after the surface voltage of the photoconductor drum 2 has been selectively discharged. Toner 8 which is stored in the toner reservoir 9 of electrophotographic print cartridge 10 moves from locations within the toner reservoir 9 to the developer roller 7. The magnet located within the developer roller 7 magnetically attracts the toner 8 to the surface of the developer roller 7. As the developer roller 7 rotates in the counterclockwise direction, the toner on the surface of the developer roller 7, located opposite the areas on the surface of photoconductor drum 2 which are discharged, is moved across the gap between the surface of the photoconductor drum 2 and the surface of the developer roller 7 to develop the latent electrostatic image.

Print media 11 is loaded from paper tray 12 by pickup roller 13 into the paper path of the electrophotographic printer 1. Print media 11 moves through the drive rollers 14 so that the arrival of the leading edge of print media 11 below photoconductor drum 2 is synchronized with the rotation of the region on the surface of photoconductor drum 2 having a latent electrostatic image corresponding to the leading edge of print media 11. As the photoconductor drum 2 continues to rotate in the clockwise direction, the surface of the photoconductor drum 2, having toner 8 adhered to it in the discharged areas, contacts the print media 11 which has been charged by transfer roller 15 so that it attracts the toner particles away from the surface of the photoconductor drum 2 and onto the surface of the print media 11. The transfer of toner particles from the surface of photoconductor drum 2 to the surface of the print media 11 does not occur with one hundred percent efficiency and therefore some toner particles remain on the surface of photoconductor drum 2. As photoconductor drum 2 continues to rotate, toner particles which remain adhered to its surface are removed by cleaning blade 16 and deposited in toner waste hopper 17.

As the print media 11 moves in the paper path past photoconductor drum 2, conveyer belt 18 delivers the print media 11 up inlet guide 19 to fuser 20. The print media 11 passes between the fuser 20 and the pressure roller 21. Pressure roller 21 provides the drive force to pull print media 11 over fuser 20 and forces print media 11 against the surface of fuser 20. Fuser 20 applies heat to print media 11 so that the toner particles are fused to the surface of print media 11. Output rollers 22 push the print media 11 into the output tray 23 after exiting the fusing operation. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference herein.

An important performance feature of the system to detect the amount of toner is the capability to determine the amount of toner remaining with the same precision throughout the full range of toner amounts. Because of this capability, measurements of the amount of toner near complete depletion of the toner are as precise as those when only a small amount of toner 8 in toner reservoir 9 has been consumed. This permits the user to accurately determine when the useable amounts of toner 8 in reservoir 9 have been consumed.

Figure 2:
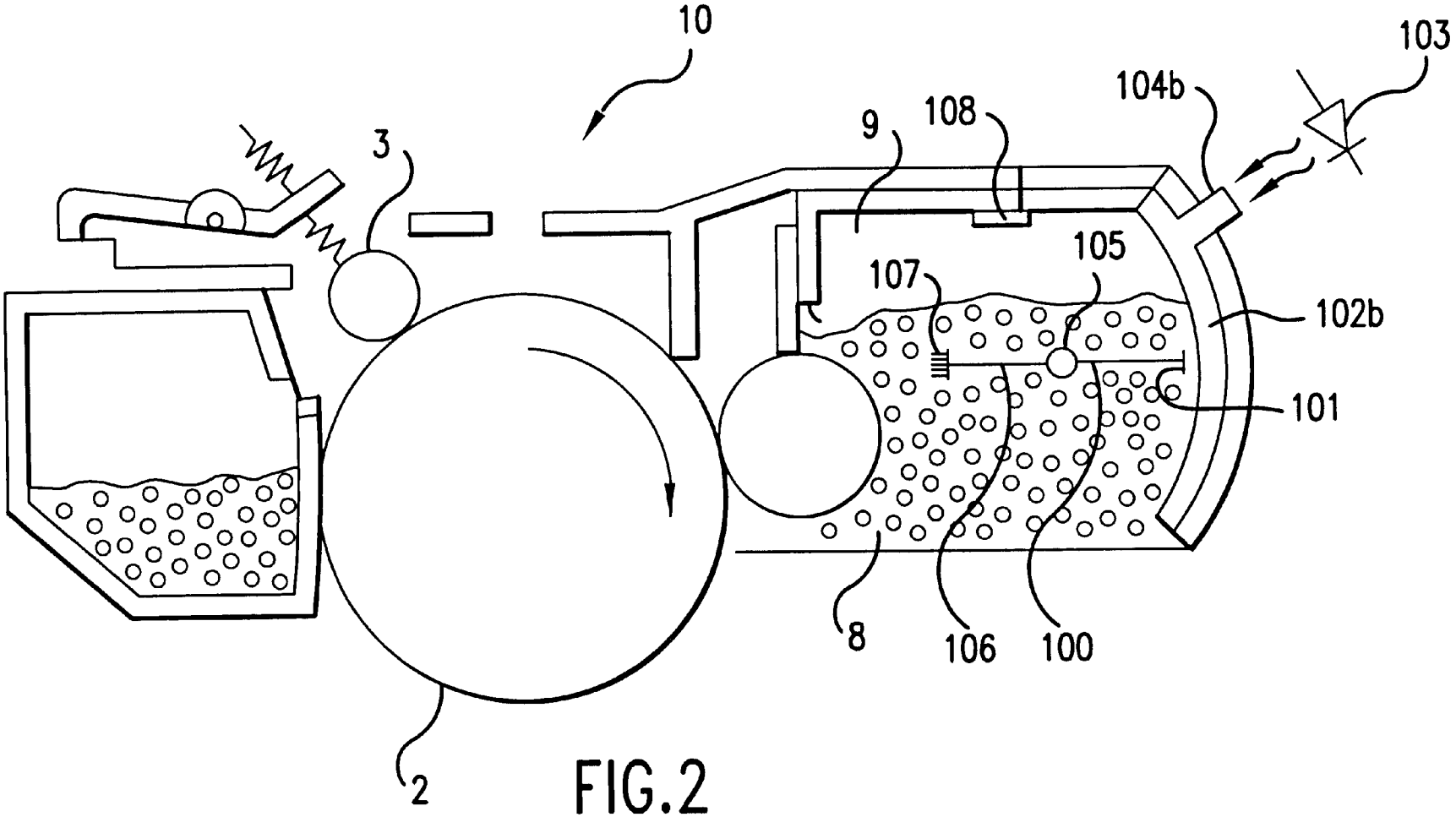
FIG. 2 shows a simplified cross section of an electrophotographic print cartridge including part of a first embodiment of the system to detect the amount of toner.

Shown in FIG. 2 is a simplified cross sectional drawing of electrophotographic cartridge 10 including a first embodiment of the system to detect the amount of toner. The system to detect the amount of toner includes a cyclically moving member, such as first arm 100 having a light coupling member, such as light bridge 101, attached to the end of first arm 100. When light bridge 101 is located adjacent to a first light guide, such as first light pipe 102*a*, and a second light guide, such as second light pipe 102*b* (only light pipe 102*b* is shown in FIG. 2), this optically connects first and second light pipes 102*a*, 102*b*. The light bridge 101 used in the first embodiment of the system to detect the amount of toner has a U shape to permit coupling of the light emitted from first light pipe 102*a* to second light pipe 102*b*. In the first embodiment of the system to detect the amount of toner, light bridge 101 is spaced 1 to 3 millimeters from first 102*a* and second light pipe 102*b*. However, it should be recognized that based upon the strength of the light source used or the sensitivity of the detector, larger or smaller spacing may be used.

Each of the disclosed embodiments of the system to detect the amount of toner includes a light coupling member. The function of the light coupling member in each of the disclosed embodiments is to provide a way in which to optically couple the light emitted from the first light guide to a circuit used to measure the time interval during which light is transmitted to the light coupling member from the first light guide.

The first embodiment of the system to detect the amount of toner shown in FIG. 2 uses first and second light pipes 102*a*, 102*b* to convey light from the top of toner reservoir 9 to the bottom of toner reservoir 9. The important performance characteristic of the light guide, such as first light pipe 102*a* or second light pipe 102*b* is that it have the capability to convey light from above the level of toner in toner reservoir 9 into toner 8 while emitting light along its length as it extends from above the level of toner in toner reservoir 9 into toner 8.

Although the first embodiment of the system to detect the amount of toner illustrated in FIG. 2 uses light bridge 101 for the light coupling member, other types of light coupling members that optically couple first and second light pipes 102*a*, 102*b* may be used. For example, a light coupling member configured to fit between first and second light pipes 102*a*, 102*b* to optically couple light between first and second light pipes 102*a*, 102*b*, may be used. Another possibility would be a light coupling member that included a controllable light source to transmit light to second light pipe 102*b* after detecting light in first light pipe 102*a*. The key functional aspect of the light coupling member is the capability to convey light to second light pipe 102*b*, which in turn couples it to a circuit, when light is detected in first light pipe 102*a*.

Light source 103 injects light into first light pipe 102*a* through window 104*a*. Although the light source 103 disclosed in the first embodiment of the system to detect the amount of toner shown in FIG. 2 is a light emitting diode, it should be recognized that other light sources such as an incandescent lamp or a source of laser light could be used for light source 103. First arm 100 is fixed to auger shaft 105 at right angles to the axis of auger shaft 105. As auger shaft 105 rotates to stir toner 8 in toner reservoir 9, first arm 100 rotates inside toner reservoir 9 moving light bridge 101. Also attached to auger shaft 105 is a second arm 106. Second arm includes a cleaning bush 107 attached to its end. As auger shaft 105 rotates, second arm 106 rotates inside toner reservoir 9 moving cleaning brush 107. Cleaning brush 107 cleans the portions of first and second light pipes 102*a* and 102*b* above the level of toner 8 as it rotates past first and second light pipes 102*a* and 102*b*. If first and second light pipes 102*a* and 102*b* are not cleaned, transmission of light to light bridge 101 may be interrupted, thereby resulting in a false indication of the level of toner 8. The position of auger shaft 105 within toner reservoir 9 and the length of first arm 100 is such that light bridge 101 contacts brush 108 as it rotates in toner reservoir 9. Additionally, the length of first arm 100 permits light bridge 101 to move adjacent to the first and second light pipes 102*a*, 102*b* as first arm 100 rotates.

Figure 3:
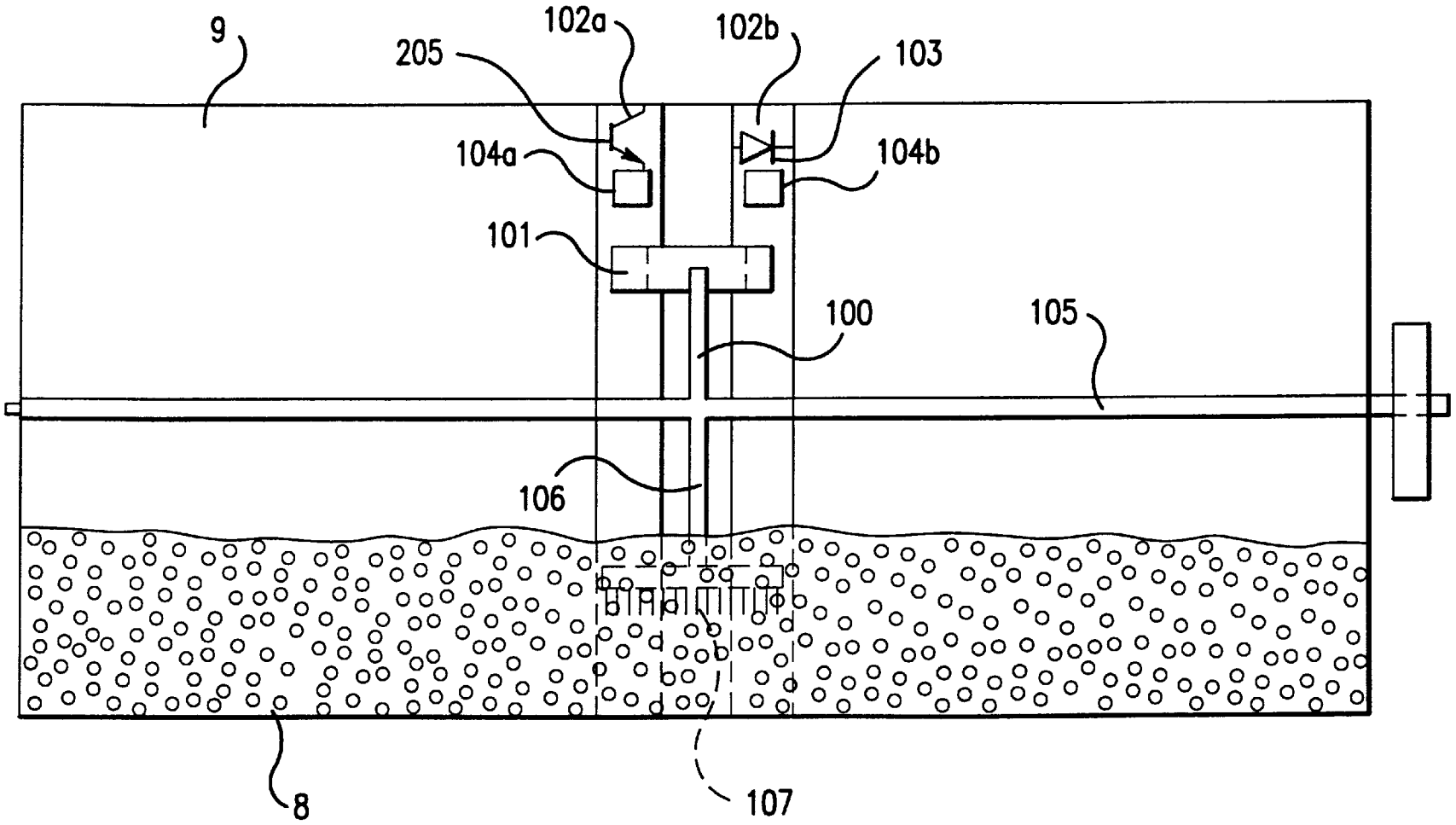
FIG. 3 shows an interior view of the electrophotographic print cartridge of FIG. 2.

Shown in FIG. 3 is a view of the interior of electrophotographic print cartridge 10 illustrating the relationship between the first and second light pipes 102*a*, 102*b* and light bridge 101. The direction of rotation of auger shaft 105 is such that first 100 and second 106 arms enter toner 8 between auger shaft 105 and the first and second light pipes 102*a*, 102*b*. While light bridge 101 is immersed in toner 8, toner present between light bridge 101 and first and second light pipes 102*a*, 102*b* attenuates the transmission of light between first light pipe 102*a* and light bridge 101. The attenuation of the transmission of light is detectable with a sufficiently sensitive detection circuit. If light bridge 101 is located sufficiently far from the surface of light pipe 102*a*, toner 8 attenuates the transmission of light between first light pipe 102*a* and light bridge 101 to the extent that the transmission of light between first and second light pipes 102*a*, 102*b* is prevented.

First light pipe 102*a* conveys light from the location at which light enters into first light pipe 102*a* to the end of first light pipe 102*a* near the bottom of toner reservoir 9. Additionally, first light pipe 102*a* emits light along its length. Second light pipe 102*b* receives light coupled from first light pipe 102*a* by light bridge 101 and conveys this light to the location at which it can exit second light pipe 102*b*, near the top of toner reservoir 9. The construction and positioning of first and second light pipes 102*a*, 102*b* prevents the transmission of light from first light pipe 102*a* to second light pipe 102*b* over the lengths of first and second light pipes 102*a*, 102*b* without coupling from light bridge 101. First and second light pipes could be formed from a variety of materials, such as plastic or glass, which permit the propagation of light by total internal reflection. The first and second light pipes 102*a*, 102*b* of the system to detect the amount of toner shown in FIG. 3 are formed from a plastic material. Semi-circular grooves are formed or cut on one surface along the length or longitude of the first and second light pipes 102*a*, 102*b*. A portion of light propagating internally along the length of first and second light pipes 102*a*, 102*b* will strike the semi-circular grooves. The semi-circular grooves serve to randomize the angle of reflection of the light from the grooves. The reflection of the light from the semi-circular grooves internal to the first and second light pipes 102*a*, 102*b* can result in light striking other internal surfaces at less than the critical angle, thereby resulting in the transmission of light out of the first and second light pipes 102*a*, 102*b* from the surface opposite the semicircular grooves.

The construction of first and second light pipes 102*a*, 102*b* permits the bi-directional transmission of light. This permits the same type of light pipe to be used for first and second light pipes 102*a*, 102*b*. Light entering the end of the light pipe is emitted along the length of the light pipe primarily from the surface opposite the semi-circular grooves. Conversely, light entering the light pipe through the surface opposite the semi-circular grooves is transmitted down the length of the light pipe and through the end. It should be recognized that first and second light pipes 102*a*, 102*b* may have a variety of shapes, such as oval shaped or bar shaped, and perform as needed.

Light bridge 101 conveys light emitted from the surface of first light pipe 102*a* located opposite the semi-circular grooves to the surface of second light pipe 102*b* located opposite the semi-circular grooves. Light emitted from the other surfaces of first light pipe 102*a* may be received by second light pipe 102*b* and interfere with the accurate detection of the level of toner 8. To prevent the loss of light from sides of first light pipe not located opposite the semi-circular grooves, a reflective or opaque coating could be used on the surface of the light pipe.

First and second light pipes 102*a*, 102*b* are positioned in toner reservoir 9 so that the surfaces having the semi-circular grooves are located opposite each other. This prevents light transmission between first and second light pipes 102*a*, 102*b* without the coupling provided by light bridge 101. The interior of toner reservoir 9 has low reflectance so that first and second light pipes 102*a*, 102*b* are not optically coupled by light reflected from the walls of toner reservoir 9. When light bridge 101 is positioned adjacent to first and second light pipes 102*a*, 102*b*, light transmitted out of first light pipe 102*a* is transmitted through the air gap substantially unattenuated and into light bridge 101. The light transmitted into light bridge 101 is coupled to second light pipe 102*b*. To accomplish this coupling, light bridge 101 may include a mirror or may have a structure similar to first and second light pipes 102*a*, 102*b*. The light coupled to second light pipe 102*b* is coupled through window 104*a* to a detection circuit.

Figure 4:
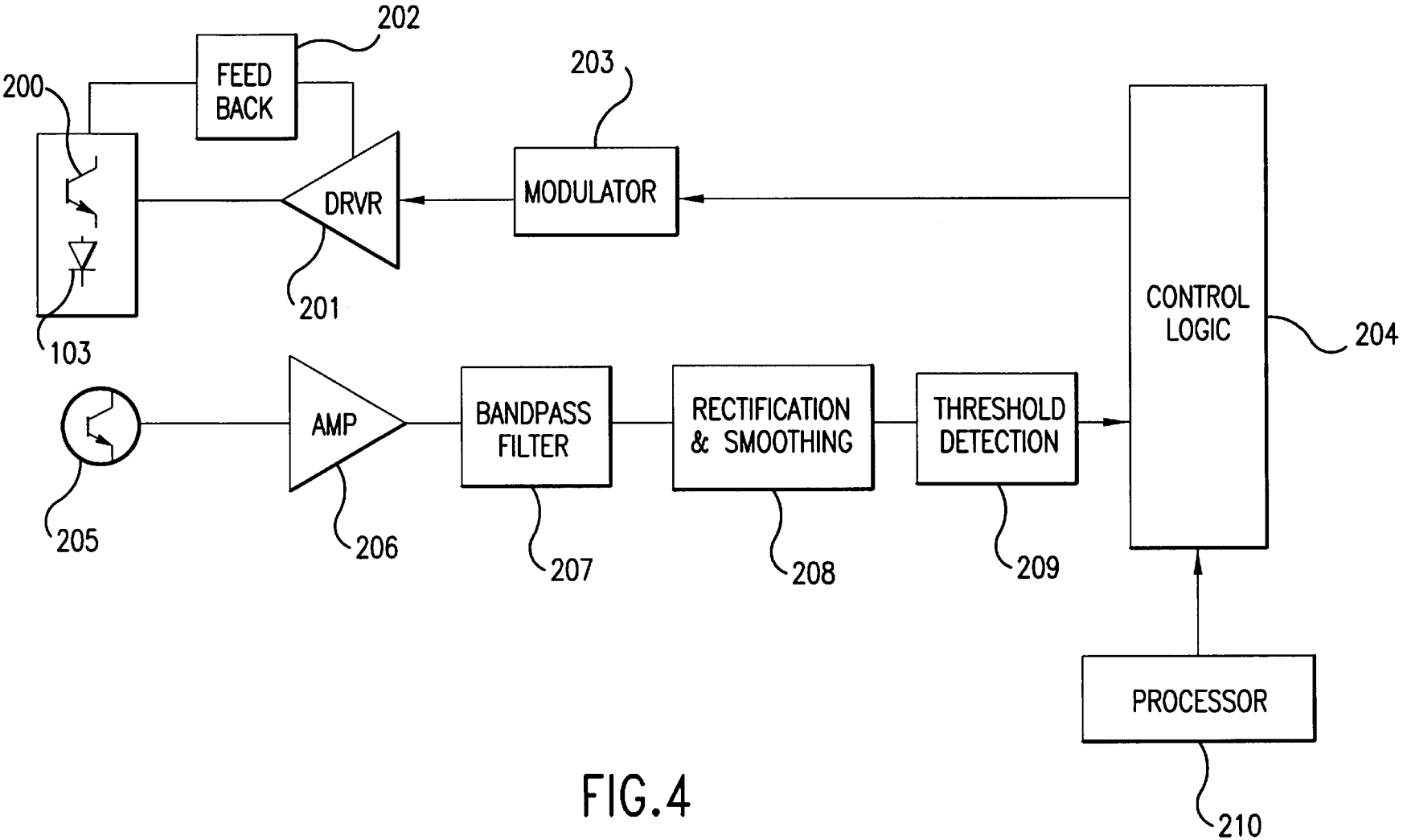
FIG. 4 shows a simplified block diagram of a schematic of a circuit for use with embodiments of the system to detect the amount of toner.

Shown in FIG. 4 is a simplified schematic of an embodiment of a circuit used with the structure of FIGS. 1 through FIG. 3 to accomplish the measurement of the level of toner in toner reservoir 9. The circuit of shown in FIG. 4 is optimized for use in the presence of ambient light. The circuit shown in FIG. 4 could be considerably simplified if ambient light interference was not a concern. Light source 103 is an infrared light emitting diode. The wavelength selected for light source 103 is infrared in order to minimize the interference of ambient light with the light signal. It should be recognized that other wavelengths outside of the visible spectrum could be used or a very narrow range of wavelengths within the visible spectrum could be used. Furthermore, for those environments in which ambient light is not a problem (for example, inside of some electrophotographic printing systems), a broad band light source may be used.

Included in light source 103 is a photodiode 200 for monitoring the output power of light source 103. The signal from photodiode 200 is applied to the driver 201 of light source 103 through feedback element 202. By utilizing feedback, the light power output of light source 103 is maintained at a substantially constant level. By maintaining the output of light source 103 at a substantially constant level, false detection of the optical connection of first and second light pipes 102*a*, 102*b* by light bridge 101 or false detection of the interruption of light transmission between first and second light pipes 102*a*, 102*b* as a result of drift in the output is avoided.

Driver 201 provides the signal which causes light source 103 to emit light. Driver 201 is coupled to a modulator 203. Modulator 203 provides a signal at a fixed frequency and duty cycle to driver 201. Modulator 203 could be operated at 10 kilohertz to provide a square wave with a superimposed DC level to driver 201. The circuit of FIG. 4 could also be configured to operate with a modulator 203 having a different modulation frequency. By using modulator 203, a peak in the output light power spectrum of light source 103 is generated at the modulation frequency. This permits a detection circuit to be used which is tuned to the modulation frequency and thereby rejects ambient light interference with the output of light source 103. Control logic 204 starts modulator 203 to perform a measurement of the toner level and stops modulator 203 after measurement of the toner level is complete.

As is shown in FIG. 2, light source 103 is located adjacent to window 104*a* to allow transmission of light into light pipe 102*b*. In order to reduce interference from ambient light, windows 104*a*, 104*a* could be formed of a material that preferentially allows transmission of the wavelength of light emitted by light source 103. So, if for example, light source 103 includes an infra-red light emitting diode, windows 104*a*, 104*a* would be formed from a material that passes light in the infra-red wavelengths and attenuates non-infrared wavelengths of light. Photodiode 205 is located adjacent to window 104*a* to receive light transmitted from light pipe 102*b* to light pipe 102*a*. If an infrared light emitting diode is used for light source 103, photodiode 205 would be selected to be of the type most sensitive to infra-red wavelengths. The signal detected by photodiode 205 is amplified by amplifier 206. Bandpass filter 207 filters the output of amplifier 206. The center frequency of bandpass filter 207 is located at a frequency determined by the modulation frequency of modulator 203 and the rotation rate of first arm 100 so that the energy at frequencies located around the peak of the power spectrum of the output from photodiode 205 is passed through bandpass filter 207. Electrophotographic printer 1 can be a source of electrical interference. By using a modulated signal (with the modulation frequency selected so that it does not coincide with interference frequencies generated by electrophotographic printer 1), bandpass filter 207 in the detection circuit provides improved noise rejection capability.

Bandpass filter 207 is coupled to rectifier and smoothing filter 208. The output of the rectifier and smoothing filter 208 is a DC voltage. The level of the DC voltage output of the rectifier and smoothing filter 208 increases with an increasing output from bandpass filter 207. The output of rectifier and smoothing filter 208 is coupled to threshold detector 209. Threshold detector 209 detects the DC voltage level output from rectifier and smoothing filter 209 to determine when a signal from light source 103 has been transmitted between first and second light pipes 102*a*, 102*b*.

Control logic 204 monitors the output of threshold detector 209. Control logic 204 determines the time interval between the times at which the transmission of light between first and second light pipes 102*a*, 102*b* begins and is then subsequently interrupted. The implementation of the functions of control logic 204 could be done through a dedicated state machine or through a microprocessor programmed to accomplish the required operations. Using this measurement generated by control logic 204, processor 210 can calculate the level of toner 8 remaining in toner reservoir 9. As previously mentioned, if light bridge 101 is spaced sufficiently close to the surface of first and second light pipes 102*a*, 102*b*, then light transmission will be attenuated instead of interrupted. Under this condition, the time interval could still be measured by controlling the level of detection of threshold detector 209.

Calculation of the level of toner remaining in toner reservoir 9 could be done by interpolation between predetermined pairs of values of the level of toner and the corresponding value of the time interval, using processor 210. The table of predetermined values contains pairs of values of the measured toner level and the corresponding time intervals. The empirically determined pairs of values of toner levels and time intervals would vary depending upon the shape of toner reservoir 9.

Figure 5:
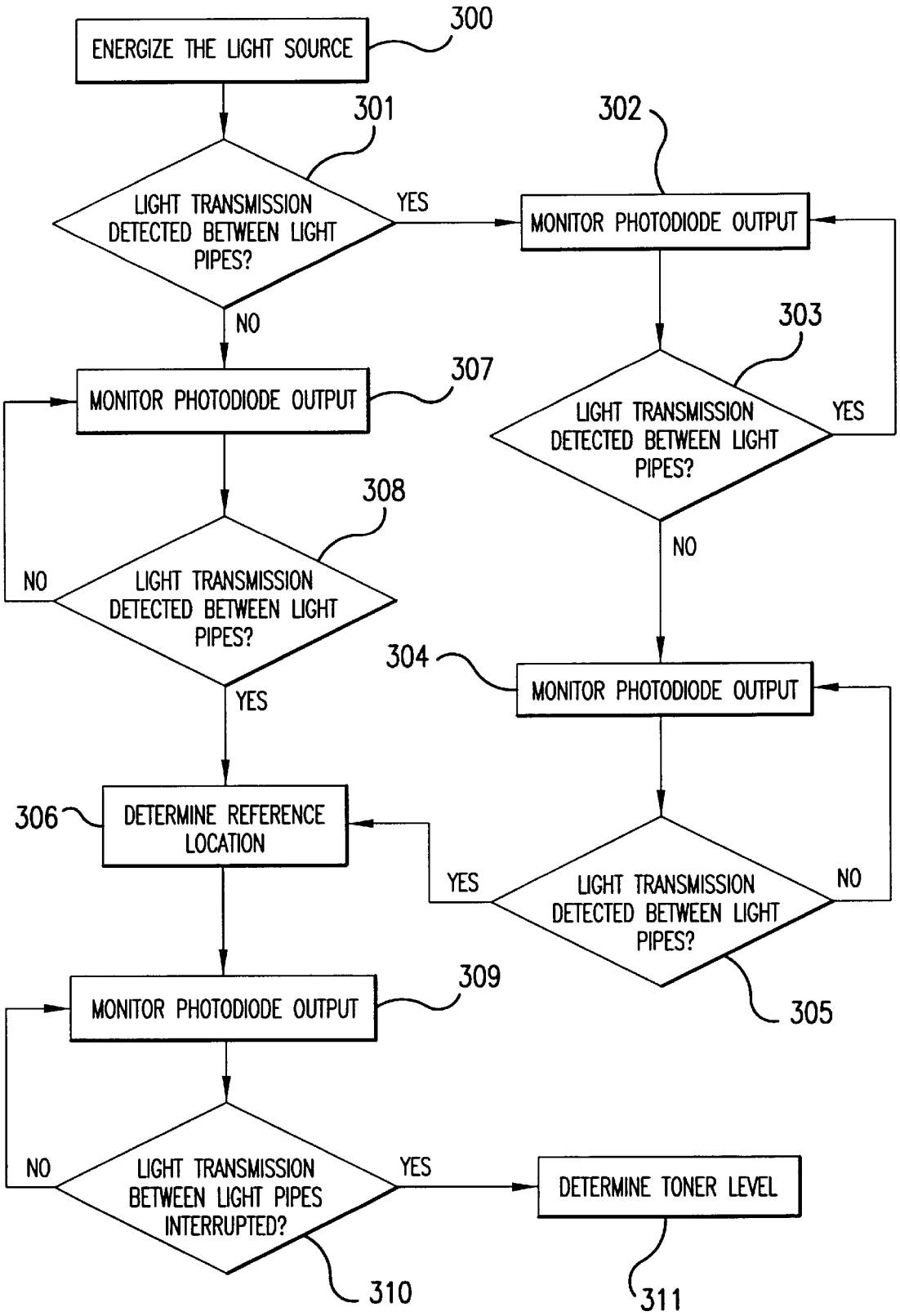
FIG. 5 is a simplified flow chart of a method for using the first embodiment of the system to detect the amount of toner.

Shown in FIG. 5 is a simplified flow chart of a method of using the system to detect the amount of toner to measure the toner level in electrophotographic print cartridge 10. Measurement of the toner level is made during times in which the drive motor of electrophotographic printer 1 is in operation. When the drive motor is operating, auger shaft 105 is rotating thereby causing first 100 and second 106 arm to rotate allowing the system to detect the amount of toner to operate. First, light source 103 is energized 300 using control logic 204. Next, control logic 204 is used to determine 301 if light bridge 101 is positioned to allow the transmission of light between first and second light pipes 102*a*, 102*b*.

If light bridge 101 is positioned to allow the transmission of light between first and second light pipes 102*a*, 102*b*, this indicates that light bridge 101 is located somewhere from the reference position (the position at the top of first and second light pipes 102*a*, 102*b* at which the light bridge 101 can first allow the transmission of light between first and second light pipes 102*a*, 102*b* in its rotation) to the surface formed by the top of toner 8. With the light bridge in this possible range of locations, the reference location will have to be detected by allowing light bridge 101 to rotate until it reaches the top of first and second light pipes 102*a*, 102*b*. To accomplish this, control logic 204 continues to monitor 302 the output of photodiode 205 to determine 303 when light transmission between first and second light pipes 102*a*, 102*b* is interrupted. When control logic 204 determines 303 that light transmission has been interrupted, then control logic 204 begins to monitor 304 the output of photodiode 205. The interruption of the transmission of light between first and second light pipes 102*a*, 102*b* by light bridge 101 occurs when the rotation of first arm 100 pulls light bridge 101 into toner 8. Then, control logic 204 determines 305 when the transmission of light between first and second light pipes 102*a*, 102*b* is again established. At the instant this occurs, the reference location is determined 306.

In the first instance of using control logic 204 to determine 301 if there is light transmission between first and second light pipes 102*a*, 102*b*, if no light was detected that indicated that light bridge 101 was positioned somewhere else in its rotation other than at the reference position or between the reference position and the top of the surface formed by toner 8. If this is the case, control logic 204 is used to monitor 307 the output of photodiode 205. Control logic 204 then determines 308 is light is transmitted between first and second light pipes 102*a*, 102*b*. If light is not transmitted, then control logic 204 continues to monitor 307 photodiode 205. At the instant control logic 204 determines 308 that light is transmitted between first and second light pipes 102*a*, 102*b*, control logic 204 determines the reference location 306. Then control logic 204 monitors 309 the output of photodiode 205 and determines 310 when transmission of light between first and second light bridge 102*a*, 102*b* is interrupted. If transmission is not interrupted, control logic 204 will continue to monitor 309 the output of photodiode 205. If it is determined 310 that transmission between first and second light bridge 102*a*, 102*b* is interrupted, at that instant, control logic 204 determines 311 the level of toner 8 in toner reservoir 9.

The level of toner 8 in toner reservoir 9 is accomplished by using control logic 204 to measure the time interval between the detection of the reference position and the interruption of the transmission of light between first and second light pipes 102*a*, 102*b*. By measuring this time interval and knowing the rotation speed of first arm 100, the level of toner 8 in toner reservoir 9 can be computed. Alternatively, control logic 204 could access a table which stores empirically derived values of the toner level associated with corresponding toner levels. Furthermore, once the level of toner 8 in toner reservoir 9 has been determined, the remaining volume of toner 8 in toner reservoir 9 could be estimated based upon the shape of toner reservoir 9.

Figure 6:
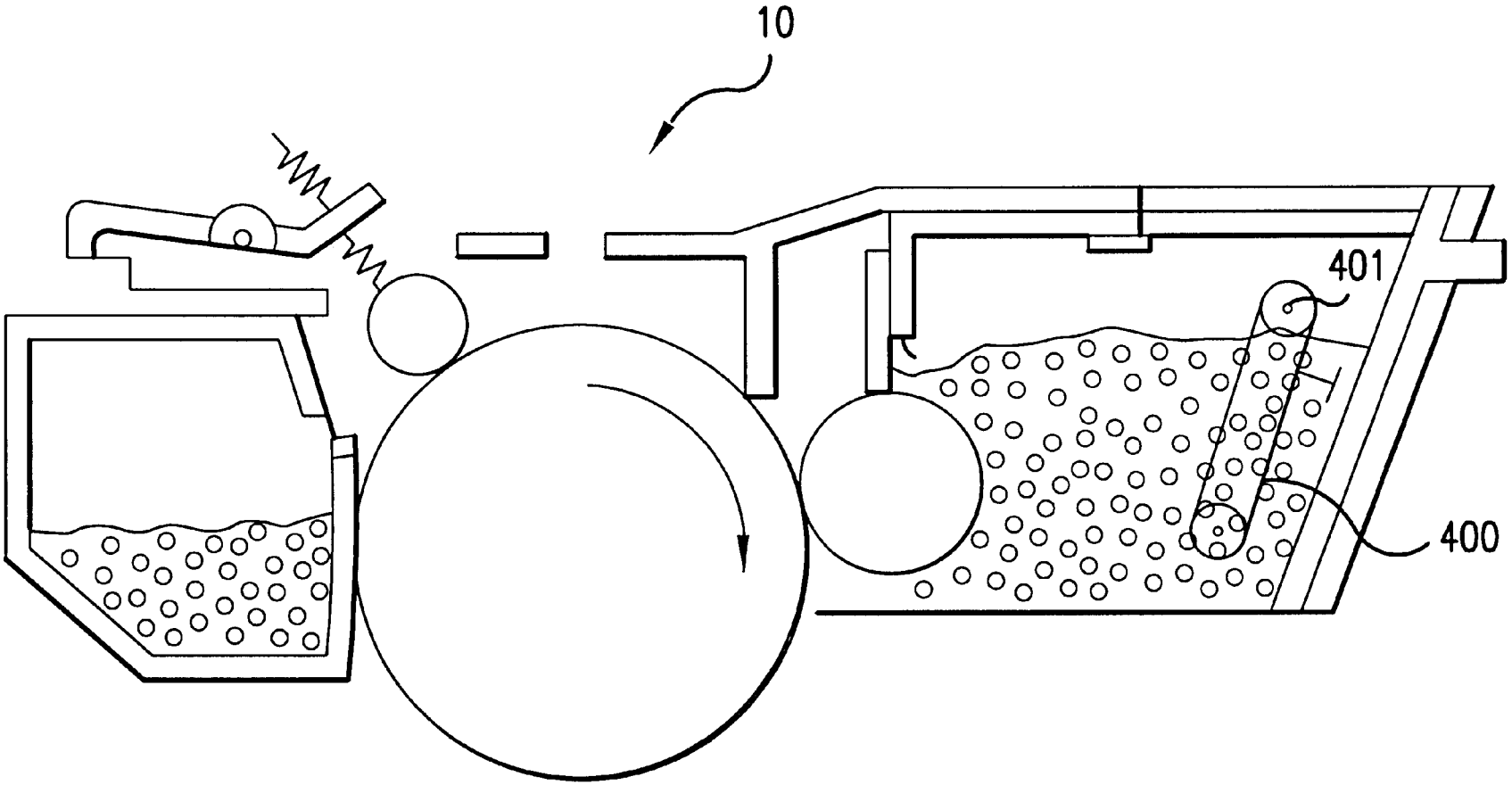
FIG. 6 is a simplified cross section of an electrophotographic print cartridge including part of a second embodiment of the system to detect the amount of toner.

Shown in FIG. 6, is an illustration of a second embodiment of the system to detect the amount of toner implemented in electrophotographic print cartridge 10. In the second embodiment of the system to detect the amount of toner, a cyclically moving member, such as belt 400 is used for moving light bridge 101 from the top to the bottom of first and second light pipes 102*a*, 102*b*. Belt 400 is driven by shaft 401. In addition to providing drive power to belt 400, shaft 401 also drives the mechanism to stir toner in toner reservoir 9. The operation of the second embodiment of the system to detect the amount of toner is very similar to that of the first embodiment of the system to detect the amount of toner. The primary difference is in the mechanism used to move light bridge 101.

Figure 7:
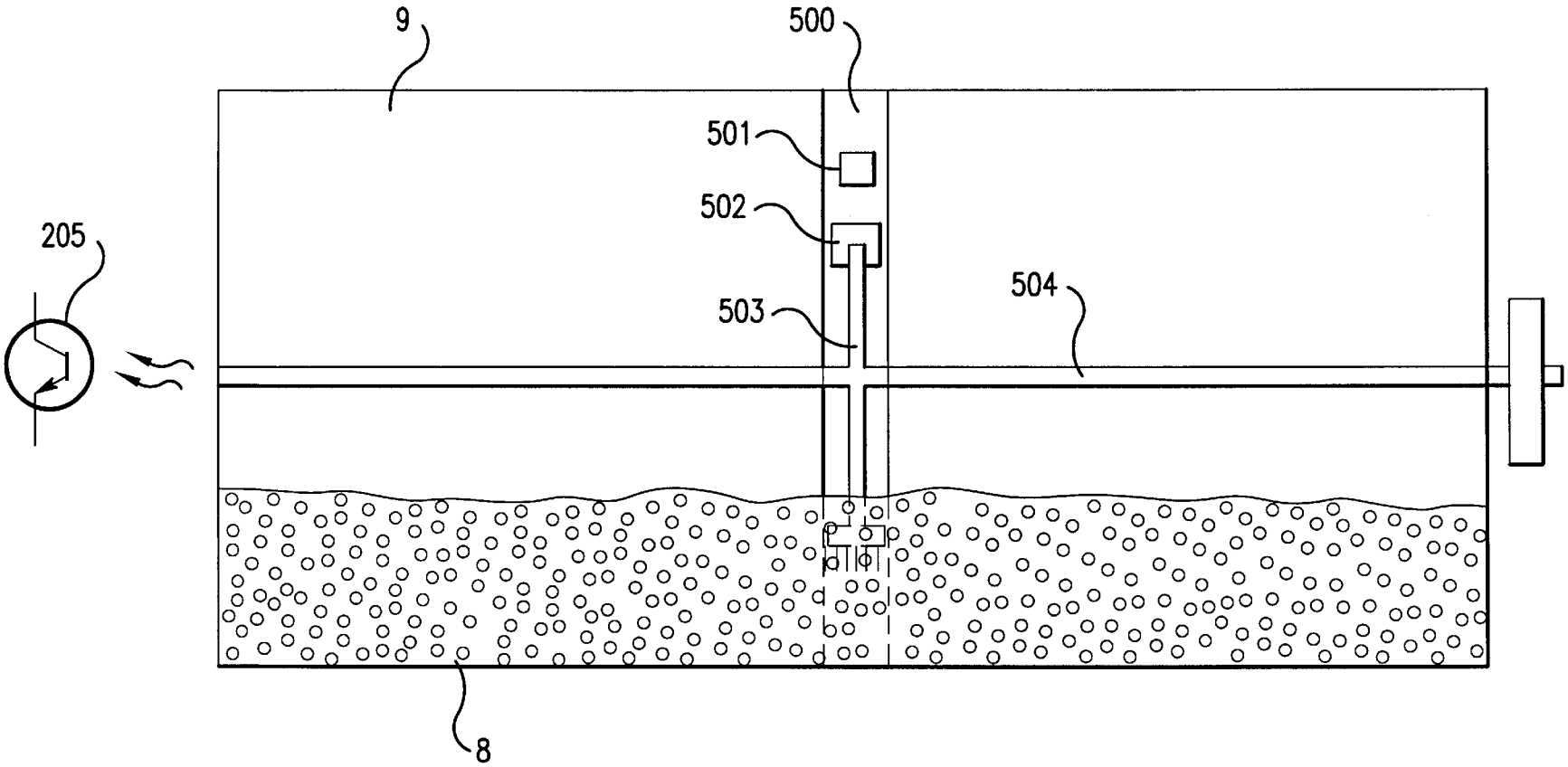
FIG. 7 shows an interior view of an electrophotographic print cartridge containing part of a third embodiment of the system to detect the amount of toner.

Shown in FIG. 7, is an illustration of a third embodiment of the system to detect the amount of toner. The third embodiment of the system to detect the amount of toner performs the toner level detection function using a single light pipe 500. Light pipe 500 receives light from photodiode 103 through window 501. As well as providing mechanical support for light coupling member 502, first arm 503 performs a light guiding function. When the light coupling member 502 is located adjacent to light pipe 500 and outside of toner 8, light is transmitted from light pipe 500 to light coupling member 502. Then, the light transmitted to light coupling member 502 is transmitted to first arm 503. As well as providing the drive power for stirring toner 8, auger 504 performs a light guiding function. The light transmitted through first arm 503 is transmitted into auger 504. The light transmitted into auger 504 is guided through auger 504 and coupled to photodiode 205.

The third embodiment of the system to detect the amount of toner accomplishes the detection of the level of toner 8 in toner reservoir 9 similar to the first and second embodiments of the system to detect the amount of toner. Light coupling member 502 rotates as first arm 503 rotates. Over part of the path followed by light coupling member 502, light coupling member 502 is positioned adjacent to light pipe 500. While light coupling member 502 is positioned adjacent to light pipe 500 outside of toner 8, light is transmitted into light coupling member 502. Control logic 204 determines the instant at which light coupling member 502 begins receiving light transmitted from light pipe 500. When light coupling member 502 rotates to a position at which it is immersed in toner 8, the transmission of light from light pipe 500 to light coupling member 502 is interrupted. Control logic 204 determines the instant at which the interruption of light transmission from light pipe 500 occurs. Control logic 204 uses the measured time interval between the beginning of light transmission from light pipe 500 and the interruption of light transmission from light pipe 500 to determine the level of toner in toner reservoir 9.

Figure 8:
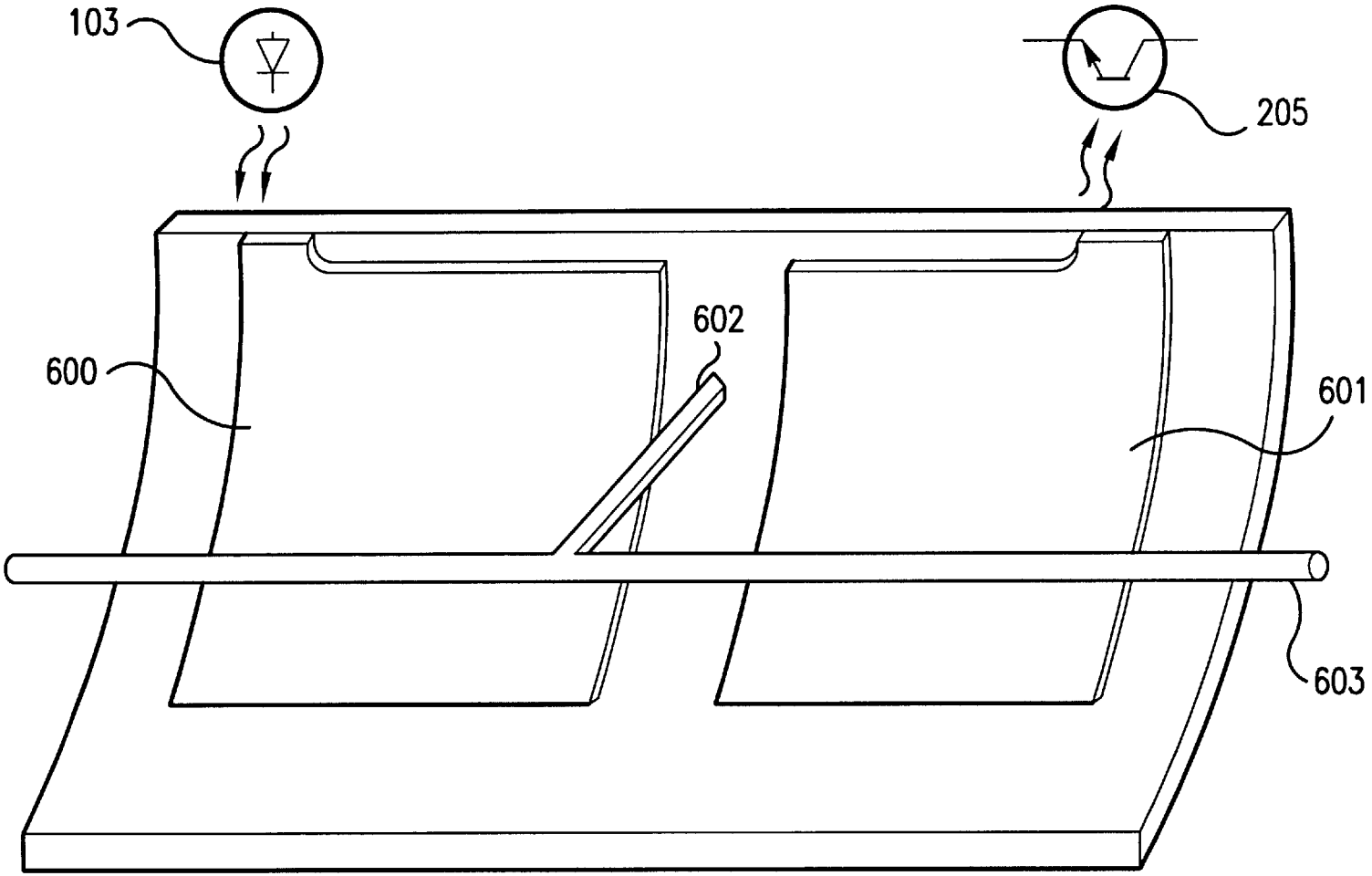
FIG. 8 shows part of an interior view of an electrophotographic print cartridge containing part of a fourth embodiment of the system to detect the amount of toner.

Shown in FIG. 8 is part of a fourth embodiment of the system to detect the amount of toner. For clarity of illustration, only the rear wall of electrophotographic print cartridge 10 containing part of the fourth embodiment of the system to detect the amount of toner is illustrated. The part of the fourth embodiment of the system to detect the amount of toner illustrated in FIG. 8 uses the circuit disclosed in FIG. 4 to accomplish the detection of the amount of toner. This embodiment uses a first light pipe 600 and a second light pipe 601. First light pipe 600 includes a polarizer to polarize the light exiting first light pipe 600. The polarizer of first light pipe 600 is located to polarize light emitted from the surface opposite second light pipe 601. Second light pipe 601 includes a polarizer to block light from entering second light pipe 601 without the polarization of the polarizer. The polarizers of first 600 and second light pipes 601 have polarizations at right angles to each other. Therefore, light emitted from first light pipe 600 will not enter second light pipe 601.

A light coupling member, such as half waveplate 602, is coupled to auger 603 through a cyclically moving member. Half waveplate 602 rotates as auger 603 rotates. The light entering half waveplate 602 from first light pipe 600 has its polarization rotated by 90 degrees. The rotation of the polarization of the light emitted from first light pipe 600 by 90 degrees by half waveplate 602 makes the polarization of the light emitted from half waveplate 602 aligned with the polarizer of second light pipe 601. Therefore, the light emitted by half waveplate 602 can enter second light pipe 601. The light output of the second light pipe is coupled to the photodiode 205 of the circuit shown in FIG. 4.

The fourth embodiment of the system to detect the amount of toner uses a similar operating principle to the other embodiments of the system to detect the amount of toner. When half waveplate 602 moves to the reference position (as in the other embodiments of the system to detect the amount of toner, the reference position is located in the gap between the top of first 600 and second light pipe 602) control logic 204 detects the transmission of light between first 600 and second light pipe 602. At some point in the rotation of half waveplate 602 toward the bottom of the first 600 and second light pipe 601, half waveplate 602 will enter toner 8 (the location where this occurs is the toner detect position). When half waveplate 602 enters toner 8, light transmission between first 600 and second light pipe 601 is interrupted. Control logic 204 detects the interruption of the transmission of light between first 600 and second light pipe 601 and determines the time interval between the reference position and the instant at which the transmission between first 600 and second light pipe 601 was interrupted. Control logic 204 then uses the measured time interval to perform an interpolation, using values from a look up table, to determine the amount of toner remaining in toner reservoir 9.

Figure 9:
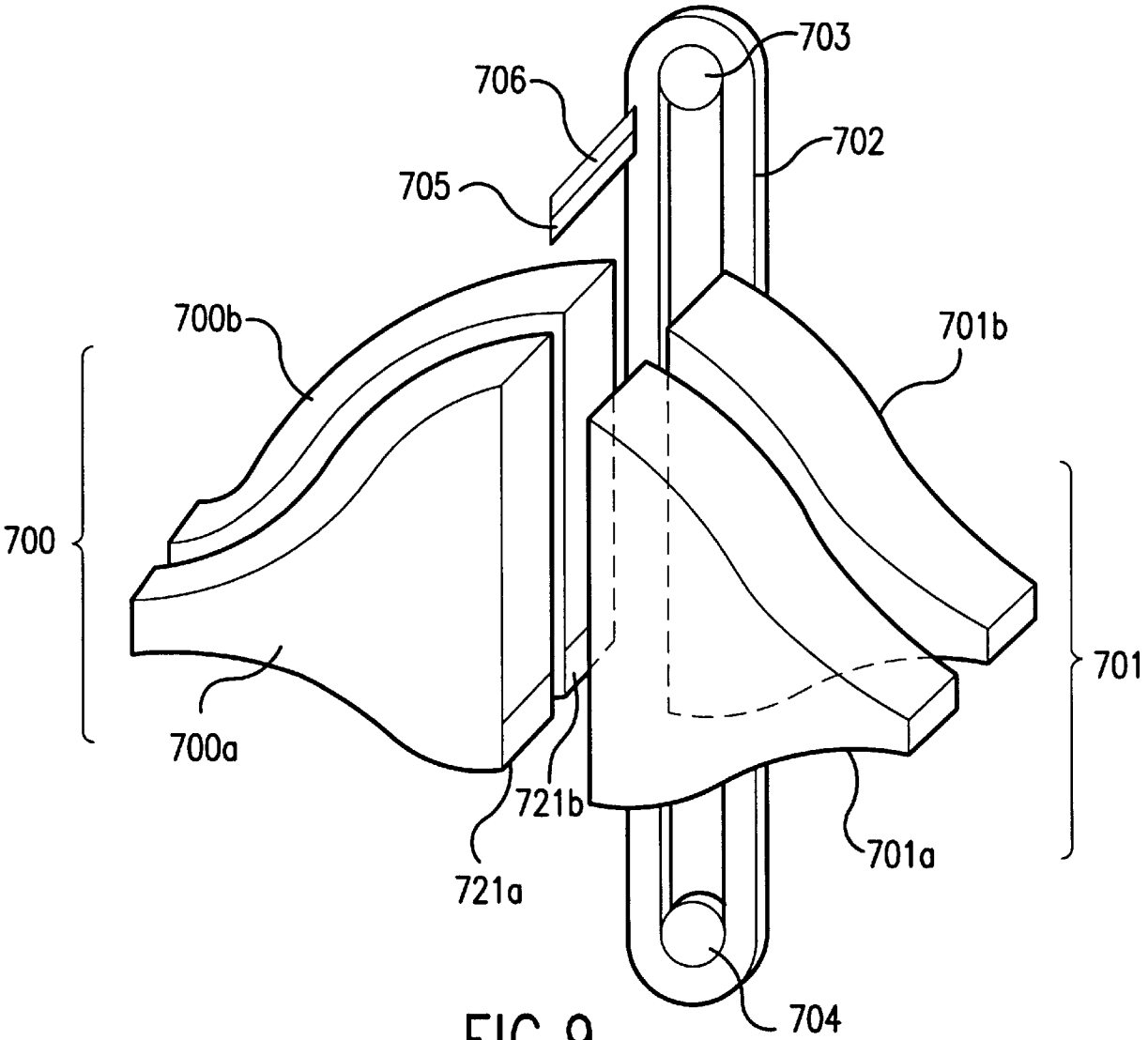
FIG. 9 shows part of the structure of a fifth embodiment of the system to detect the amount of toner.

Shown in FIG. 9 is part of a fifth embodiment of the system to detect the amount of toner. For clarity of illustration, the electrophotographic print cartridge 10 in which the structure of FIG. 9 would be located is not shown. The fifth embodiment of the system to detect the amount of toner uses a first pair of light pipes 700 and a second pair of light pipes 701. The first pair of light pipes 700 is formed from a first light pipe 700*a* and a second light pipe 700*b*. Similarly, the second pair of light pipes 701 is formed from a first light pipe 701*a* and a second light pipe 701*b*. First light pipe 700*a* and second light pipe 700*b* have polarizations differing by 45 degrees to limit transmission of light between the first pair of light pipes 700. Similary, first light pipe 701*a* and 701*b* have polarizations differing by 45 degrees to limit transmission of light between second pair of light pipes 701. A cyclically moving member, such as belt 702, is positioned on first 703 and second drive wheels 704 with a first 705 and a second 706 half waveplate mounted on the belt 702. The belt is located within toner reservoir 9 so that the light coupling member, formed from a first 705 and a second 706 half waveplate, passes between first pair of light pipes 700 and second pair of light pipes 701. The orientation of the polarization of first 705 and second 706 half waveplate is such that first half waveplate 705 only permits the transmission of light between first light pipe 700*a* and first light pipe 701*a* and second half waveplate 706 only permits the transmission of light between second light pipe 700*b* and second light pipe 701*b*.

Figure 10:
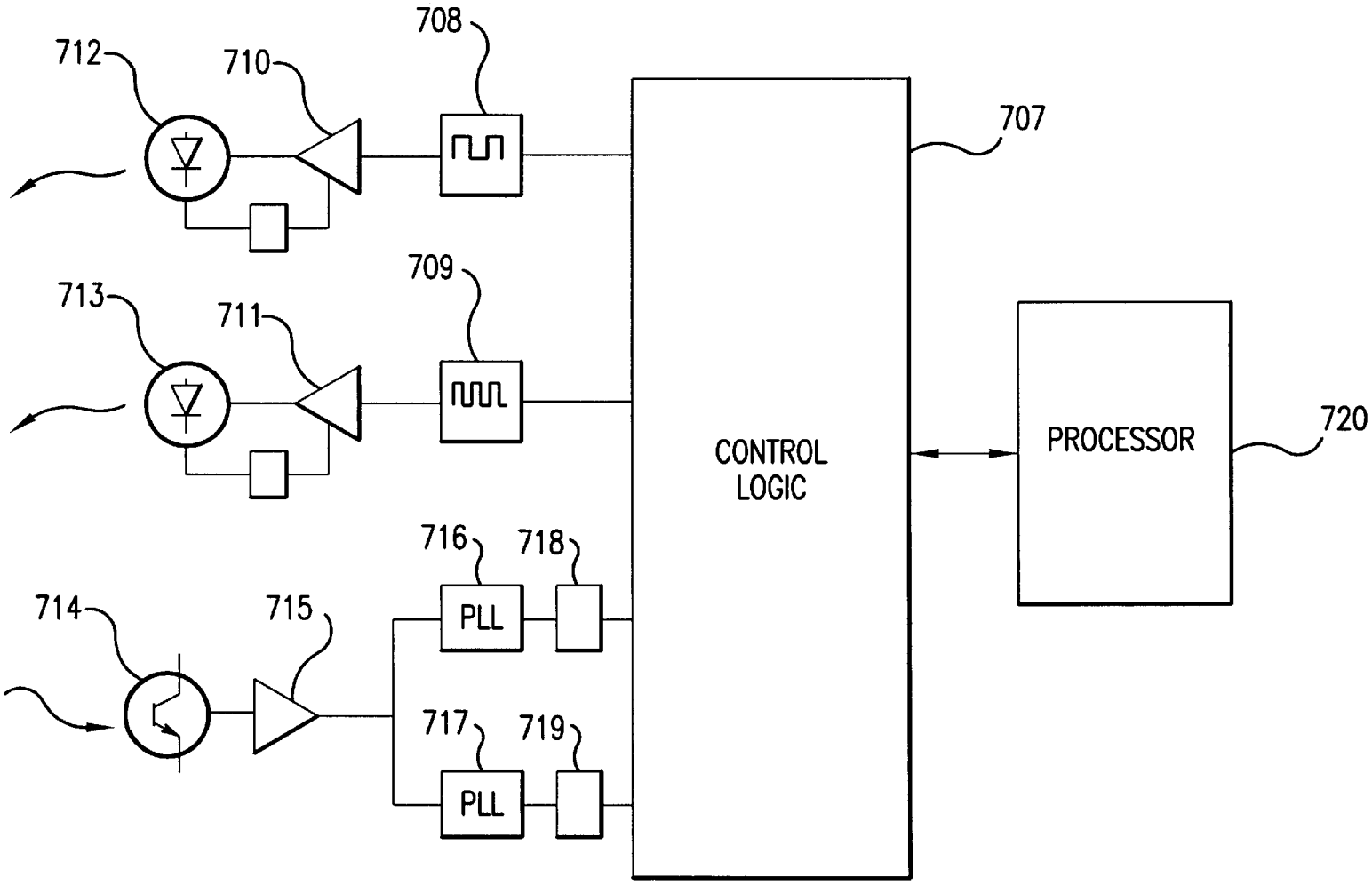
FIG. 10 shows a simplified block diagram of a schematic of a circuit for use with the structure shown in FIG. 9.

Shown in FIG. 10 is a circuit used to supply light to the first pair of light pipes 700 and to detect the transmission of light between first pair of light pipes 700 and second pair of light pipes 701. Control logic 707 provides the control signals to enable first square wave generator 708 and second square wave generator 709 to provide an output. First square wave generator 708 and second square wave generator 709 supply square waves of different frequencies with each of the square waves having an average value equal to half the peak to peak value. First driver 710 is coupled to the output of first square wave generator 708. Second driver 711 is coupled to the output of second square wave generator 709. First driver 710 supplies the drive signal to first infra-red diode 712. Second driver 711 supplies the drive signal to second infra-red diode 713. Both first driver 710 and second driver 711 use feedback to maintain the power output of the respective infra-red diodes they drive at a substantially constant level.

A single photodiode 714 is used for monitoring the output of the second pair of light pipes 701. The output of photodiode 714 is coupled to the input of an amplifier 715. The output of first amplifier 715 is input to a first 716 and a second 717 phase locked loop circuit. The first phase locked loop circuit 716 is tuned to detect the signal generated by first infra-red diode 712 and modulated at the frequency of first square wave generator 708. The second phase locked loop circuit 717 is tuned to detect the signal generated by second infra-red diode 713 and modulated at the frequency of second square wave generator 709. Modulating the outputs of first infra-red diode 712 and second infra-red diode 713 at different frequencies permits the use of a single photodiode 714 to monitor the output of the second pair of light pipes 701.

The output of the voltage controlled oscillator of each of the first 716 and the second 717 phase locked loop is coupled, respectively, to a first 718 and a second 719 detection circuit. The first 718 and the second 719 detection circuit generate a DC voltage corresponding to the average value of the respective first 716 and second 717 phase locked loop. First 718 and second 719 detection circuit could each be implemented using a diode coupled to a parallel resistor and capacitor combination. The values of the resistor and the capacitor would be selected based upon the frequencies of first square wave generator 708 and second square wave generator 709. The outputs of first 718 and second 719 detection circuit are coupled to control logic 707. Control logic 707 measures the time interval during which light is transmitted between first pair of light pipes 700 and second pair of light pipes 701. The measured time interval is loaded into processor 720 where the interpolations are performed using the measured time interval to determine the amount of toner remaining in toner reservoir 9.

Figure 11:
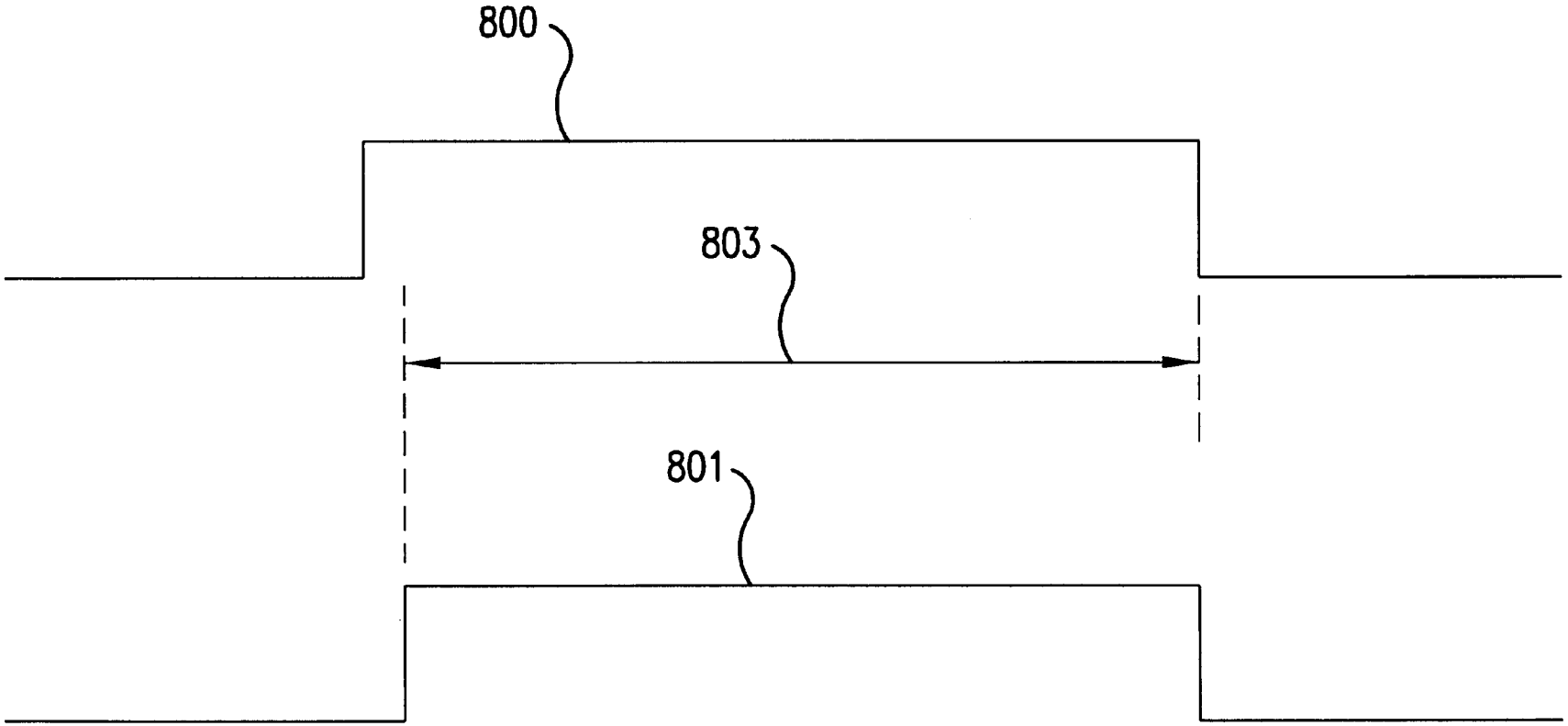
FIG. 11 shows a typical timing diagram that could be generated by the fifth embodiment of the system to detect the amount of toner.

The movement of first 705 and second 706 half waveplates on belt 702 generates the waveforms shown in FIG. 11. First waveform 800 corresponds to the movement of first half waveplate 705. Second waveform 801 corresponds to the movement of second half waveplate 706. When the first half waveplate 705 passes the reference position between first pair of light pipes 700 and second pair of light pipes 701, the output of first detection circuit 718 (first waveform 800) goes to a high level. When the second half waveplate 706 passes the reference position between first pair of light pipes 700 and second pair of light pipes 701, the output of second detection circuit 719 (second waveform 801) goes to a high level. While both first 705 and second 706 half waveplates are located between the reference position and the toner detect position, first waveform 800 and second waveform 801 are both at a high level. When the first half waveplate 705 passes the toner detect position, the first waveform 800 goes to a low level. When the second half waveplate 706 passes the toner detect position the second waveform 801 goes to a low level. The time interval from the reference position to the toner detect position is determined as the time interval 803 between the time at which the second half waveplate 706 passes the reference position and the time at which the first half waveplate 705 passes the toner detect position. This is measured on FIG. 11 as the time interval between the rising edge of second waveform 801 and the falling edge of first waveform 800.

The fifth embodiment of the system to detect the amount of toner has performance advantages over the other embodiments of the system to detect the amount of toner. Control logic 707 monitors the output of first detection circuit 718 and second detection circuit 719. If the transmission of light between either first light pipe 700*a* and first light pipe 700*b* or between either second light pipe 700*b* and second light pipe 701*b* were erroneously interrupted (for example by toner filling the gap) prior to the toner detect position, control logic 707 could detect this erroneous interruption of the light transmission (by recognizing that the time interval between the outputs of the first detection circuit 718 going low and the second detection circuit 719 going low does not equal the value for normal operation) and ignore the time interval measured. The time interval would be re-measured on a subsequent rotation of belt 702. Therefore, having two channels over which to transmit light between first pair of light pipes 700 and second pair of light pipes 701 increases the reliability of the system to detect the amount of toner.

First pair of light pipes 700 and second pair of light pipes 701 each have a portion 721*a*, 721*b* on the bottom that are not polarized. The unpolarized portions of first pair and second pair of light pipes 700, 701 serve to detect when toner 8 has reached a low level in toner reservoir 9. When toner 8 in toner reservoir 9 is sufficiently depleted, the unpolarized portions of first pair and second pair of light pipes 700, 701 are exposed and light is transmitted between first pair and second pair of light pipes 700, 701 with interruption only by the passage of first 705 and second 706 half waveplates. Control circuit 707, detects this condition and signals the processor 720 that the toner low condition has been reached.

Figure 12:
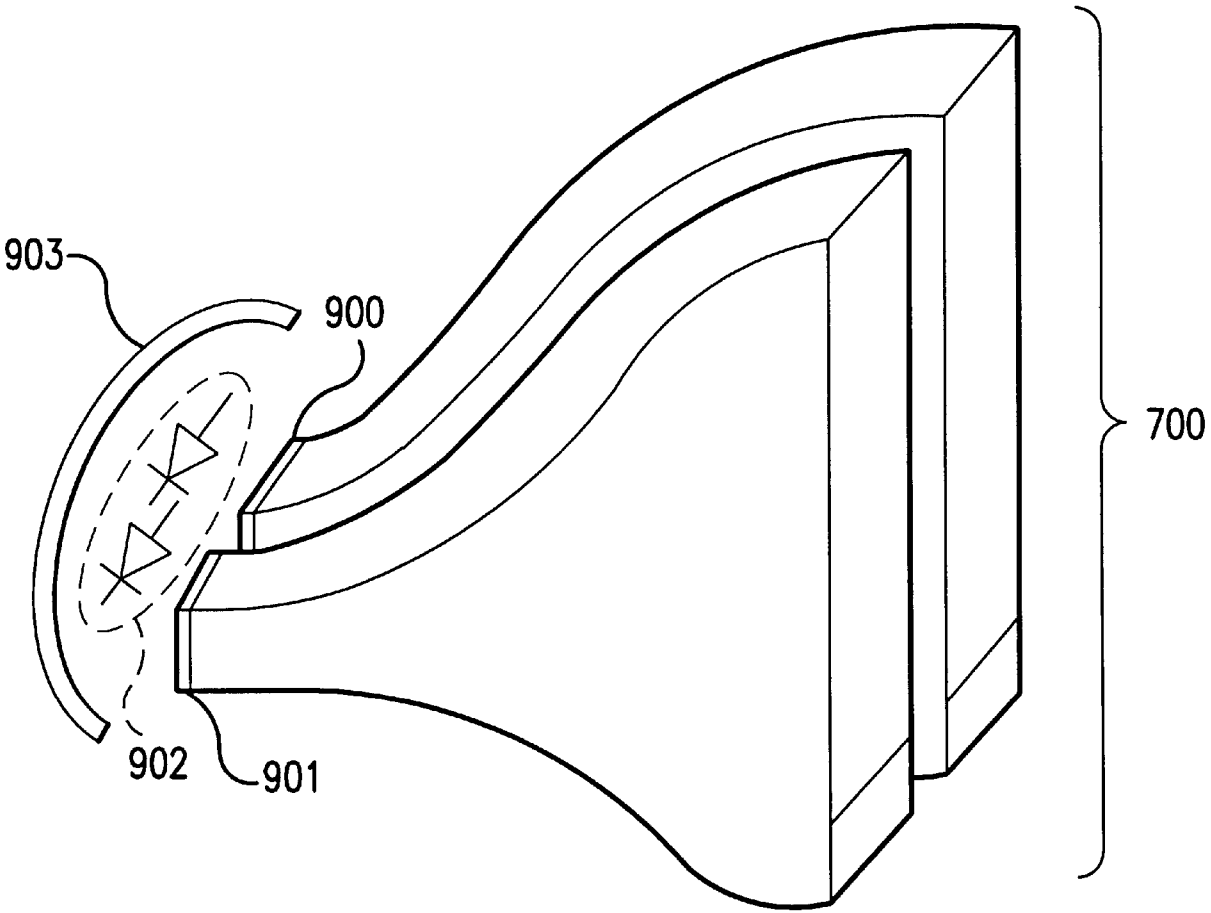
FIG. 12 shows a simplified representation of an alternative of the fifth embodiment of the system to detect the amount of toner.

It is possible to use a bi-color light emitting diode in place of first infrared diode 712 and second infra-red diode 713. Shown in FIG. 12 is a representation of an alternative to the fifth embodiment of the system to detect the amount of toner. In this alternative to the fifth embodiment, a red filter 900 and a green filter 901 would be placed at the input of first pair of light pipes 700 corresponding to each of the wavelengths of the light emitted by the bicolor light emitting diode. The red filter 900 and the green filter 901 prevent light from the bi-color light emitting diode 902 from entering the wrong one of the first pair of light pipes 700 (FIG. 12 shows part of first pair of light pipes 700). Reflector 903 assisting in guiding the red and green light emitted from bicolor light emitting diode 902 into first pair of light pipes 700. For this alternative to the fifth embodiment of the system to detect the amount of toner, the photodiode 714 would need to have a broad enough spectrum of sensitivity to permit measurement of the wavelengths coming from the bi-color light emitting diode.

In each of the disclosed embodiments of the system to detect the amount of toner, calculation of the amount of toner 8 remaining in toner reservoir 9 is performed with the assumption that the toner reservoir 9 is orientated in a horizontal position. If toner reservoir 9 is not orientated in a horizontal position, then the calculation of the amount of toner 8 remaining in toner reservoir 9 will not be accurate. However, if the degree to which toner reservoir 9 is tilted off the horizontal is known, the tilt can be accounted for in the calculation of the amount of toner 8 remaining.

An additional consideration for each of the disclosed embodiments is the effect that over filling of toner reservoir 9 will have on an accurate measurement of the amount of toner remaining. For each of the disclosed embodiments, if toner reservoir 9 is overfilled, the light coupling member will not be able to detect the reference position. Without detection of the reference position, there will be no time interval between the detection of light transmission from the light guide to the light coupling member and the interruption of the transmission of light from the light guide to the light coupling member. Therefore, overfilling of toner reservoir 9 will prevent measurement of the amount of toner remaining in toner reservoir 9 at least until enough of toner 8 is consumed so that the reference position can be detected.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. An apparatus using a light source to determine an amount of toner in a reservoir, comprising:

a first light guide configured to receive light from the light source, with the first light guide positioned in the reservoir so that depletion of the toner exposes part of the first light guide;

a light coupling member for moving between a first position outside the toner and a second position inside the toner so that with the light coupling member located in the first position, the light coupling member receives substantially unattenuated light from the first light guide and so that with the light coupling member located in the second position, the toner attenuates the transmission of light from the first light guide to the light coupling member;

a cyclically moving member coupled to the light coupling member for moving the light coupling member between the first position and the second position;

a second light guide configured to receive light from the light coupling member; and a circuit configured to receive light from the second light guide, with the circuit for determining a time interval based upon measurement of the time during which the light coupling member receives substantially unattenuated light from the first light guide with the circuit to determine the amount of toner using the time interval.

2. The apparatus as recited in claim 1, wherein:

the light coupling member optically couples to the circuit.

3. The apparatus as recited in claim 2, wherein:

the first light guide includes a first end and a second end with the first light guide positioned in the reservoir so that depletion of the toner moves a level of the toner away from the first end of the first light guide and toward the second end of the first light guide.

4. The apparatus as recited in claim 3, wherein:

during movement of the light coupling member between the first position and the second position, the light coupling member moves adjacent to the first light guide between the first end of the first light guide and the second end of the first light guide with the receiving of light by the light coupling member from the first light guide interrupted with the light coupling member located inside the toner.

5. The apparatus as recited in claim 4, wherein:

the time interval equals the time during which the light coupling member receives light from the first light guide.

6. The apparatus as recited in claim 5, wherein:

the second light guide includes a first end and a second end with the second light guide positioned in the reservoir so that depletion of the toner in the reservoir moves a level of the toner away from the first end and toward the second end of the second light guide, and with the second light guide configured to receive substantially unattenuated light from the light coupling member with the light coupling member located outside of the toner; and the cyclically moving member includes a position inside of the reservoir with the cyclically moving member for cyclically moving the light coupling member at a substantially constant rate between the first position and the second position.

7. The apparatus as recited in claim 6, wherein:

the light coupling member includes a light bridge; and the first light guide and the second light guide each include a light pipe.

8. The apparatus as recited in claim 7, wherein:

the cyclically movable member includes a belt with the light bridge attached to the belt.

9. The apparatus as recited in claim 7, wherein:

the cyclically movable member includes a rotatable auger; and the cyclically movable member includes a first arm attached to the auger and attached to the light bridge so that the first arm rotates as the auger rotates.

10. The apparatus as recited in claim 9, wherein:

the first light pipe and the second light pipe have a substantially parallel relative orientation with the first and the second light pipe each mounted interior to the reservoir;

the first light pipe includes a first window to receive light from the light source located external to the reservoir;

the circuit includes a photodiode;

the circuit includes control logic configured to receive output from the photodiode to measure the time interval; and the second light pipe includes a second window with the second light pipe for optically coupling to the photodiode through the second window.

11. The apparatus as recited in claim 10, wherein:

an electrophotographic print cartridge includes the reservoir.

12. The apparatus as recited in claim 6, wherein:

the first light guide includes a first light pipe having a first polarization orientation;

the second light guide includes a second light pipe having a second polarization orientation; and the light coupling member includes a half waveplate to receive light transmitted from the first light guide having the first polarization and transmit light having the second polarization to the second light pipe.

13. In an electrophotographic printing system, an apparatus to determine an amount of toner in a reservoir, the apparatus comprising:

a light source to generate light;

a first light guide configured to receive light from the light source, with the first light guide positioned in the reservoir so that depletion of the toner exposes part of the first light guide;

a light coupling member for moving between a first position outside the toner and a second position inside the toner so that with the light coupling member located in the first position, the light coupling member receives substantially unattenuated light from the first light guide and so that with the light coupling member located in the second position, the toner attenuates the transmission of light from the first light guide to the light coupling member;

a cyclically moving member coupled to the light coupling member for moving the light coupling member between the first position and the second position;

a second light guide configured to receive light from the light coupling member; and a circuit optically coupled to the the second light guide, with the circuit for determining a time interval based upon measurement of the time during which the light coupling member receives substantially unattenuated light from the first light guide with the circuit to determine the amount of toner using the time interval.

14. The apparatus as recited in claim 13, wherein:

the first light guide includes a first end and a second end with the first light guide positioned in the reservoir so that depletion of the toner moves the level of toner away from the first end of the first light guide and toward the second end of the first light guide.

15. The apparatus as recited in claim 14, wherein:

during movement of the light coupling member between the first position and the second position, the light coupling member moves adjacent to the first light guide between the first end of the first light guide and the second end of the first light guide with the receiving of light by the light coupling member from the first light guide interrupted with the light coupling member located inside the toner.

16. The apparatus as recited in claim 15 wherein:

the time interval equals the time during which the light coupling member receives light from the first light guide.

17. The apparatus as recited in claim 16, wherein:

the second light guide includes a first end and a second end with the second light guide positioned in the reservoir so that depletion of the toner in the reservoir moves a level of the toner away from the first end and toward the second end of the second light guide, the second light guide configured to receive substantially unattenuated light from the light coupling member with the light coupling member located outside of the toner; and the cyclically moving member includes a position inside of the reservoir for cyclically moving the light coupling member at a substantially constant rate between the first position and the second position.

18. In an electrophotographic printing system including a reservoir to contain toner, a first light guide, a second light guide, and a light coupling member, a method for determining an amount of the toner in the reservoir, comprising the steps of:

detecting transmission of light between the first light guide and the second light guide through the light coupling member with the light coupling member out of the toner;

moving the light coupling member into the toner;

detecting substantial attenuation of the light transmitted between the first light guide and the second light guide through the light coupling member when the light coupling member enters the toner; and determining the amount of the toner in the reservoir based upon a time interval between detecting transmission of the light between the first light guide and the second light guide and detecting substantial attenuation of the light transmitted between the first light guide and the second light guide.

19. The method for determining the amount of the toner as recited in claim 18, further comprising the step of:

providing light to the first light guide before detecting transmission of the light between the first light guide and the second light guide.

20. With the electrophotographic printing system including a circuit optically coupled to the second light guide, the method for determining the amount of the toner as recited in claim 19, wherein:

the step of determining the amount of the toner includes interpolating between predetermined values corresponding to the amount of the toner based upon the time interval and using the circuit.

* * * * *